United States Patent [19]

Schnitzer

[11] Patent Number: 5,033,345

[45] Date of Patent: Jul. 23, 1991

[54] HIGH-SPEED CUTTER FOR ARAMIDS

[75] Inventor: Tadeusz E. Schnitzer, Wilmington, Del.

[73] Assignee: E. I. Du Pont de Nemours and Company, Wilmington, Del.

[21] Appl. No.: 461,470

[22] Filed: Dec. 28, 1989

[51] Int. Cl.[5] ..... B26D 5/38

[52] U.S. Cl. ..... 83/366; 83/370; 83/582; 83/571; 83/950; 83/639.1

[58] Field of Search ..... 83/370, 372, 949, 950, 83/955, 639.1, 686, 571, 366, 399, 400, 402, 582, 585; 242/19

[56] References Cited

U.S. PATENT DOCUMENTS

| | | | |
|---|---|---|---|
| 2,783,838 | 3/1957 | Ericson et al. | 83/400 X |
| 2,919,794 | 1/1960 | Burn, Jr. | 83/366 X |
| 3,527,422 | 9/1990 | Conrad | 242/43 |
| 3,760,674 | 9/1973 | Temple et al. | 83/370 |
| 3,854,356 | 12/1974 | Okreglak | 83/370 X |
| 3,999,715 | 12/1976 | Schippers et al. | 242/18 A |
| 4,002,307 | 1/1977 | Turk et al. | 242/18 A |
| 4,007,884 | 2/1977 | Schippers et al. | 242/41 |
| 4,014,476 | 3/1977 | Turk et al. | 242/19 |
| 4,023,741 | 5/1977 | Schar | 242/18 R |
| 4,033,519 | 7/1977 | Abe et al. | 242/18 A |
| 4,052,017 | 10/1977 | Schar | 242/355 A |
| 4,099,679 | 7/1978 | De Baker et al. | 242/18 PW |
| 4,108,388 | 8/1978 | Schar | 242/18 DD |
| 4,157,048 | 5/1979 | Lemmar | 83/582 X |
| 4,491,282 | 1/1985 | Hübner | 242/18 PW X |
| 4,496,109 | 1/1985 | Cardell | 242/18 R |
| 4,716,801 | 1/1988 | Spaller, Jr. | 83/370 X |
| 4,789,277 | 12/1988 | Rhodes et al. | 83/13 X |
| 4,872,381 | 10/1989 | Stroms | 83/76.1 |

OTHER PUBLICATIONS

Machine and Tool Blue Book, Oct. 1988, pp. 56–59, Mel Vogle and Al Gates.

Aremco Products, Inc., Materials Catalog M12.

*Primary Examiner*—Frank T. Yost

*Assistant Examiner*—Kenneth E. Peterson

[57] ABSTRACT

An automatic yarn cutting apparatus comprising a cutter body, actuating means, valve means, and cutting means whereby the cutting mechanism is actuated by tensioned yarn passing over the actuator arm and through the cutting slot.

15 Claims, 8 Drawing Sheets

HIGH-SPEED CUTTER FOR ARAMIDS

BACKGROUND OF THE INVENTION

Conventional cutting and winding operations for yarn include a doffing/donning operation often performed manually. Typically an operator severs the yarn with scissors while the inlet of a suction or aspirator gun is held against the yarn at a point above the point of severing. Once the yarn is severed, the tail end is wound onto a yarn package while the newly formed leading end is sucked into the aspirator and fed to a waste collector. The suction gun is then placed onto a holder while the yarn package is replaced with an empty tube core. When the empty tube core attains full speed, the operator manipulates the suction gun to attach the yarn to the rotating empty tube core and then severs the yarn again by cutting or tension breaking at the suction gun so that the winding operation may continue. All the yarn going to the suction gun during the transfer time is going to waste.

In order to economize these winding operations, mechanisms which automatically sever, aspirate and rethread the yarn have been developed. U.S. Pat. No. 4,496,109, issued on the application of Cardell, discloses such an auto transfer system where a signal furnished to the machine allows pressurized fluid to be supplied to a hydraulic cylinder. The hydraulic cylinder positions a cutter and yarn aspirator so that yarn enters the cutting slot of a stationary blade adjacent the aspirator. Air is then directed by a cam actuated valve causing pressure to build up in the working compartment of a cutter sleeve. When the pressure eventually overcomes the restraint imposed by a spring ball detent, a reciprocable blade moves forward in a line to surface contact with the stationary blade thereby severing the yarn, the new leading end of which is aspirated to waste. The yarns are then threaded onto new cores, snagged by pinch grooves on the cores, and are broken as the yarn is placed in tension between the aspirator and rotating pinch grooves.

More efficient winders for aramid fibers require auto sever, no waste, transfer devices to sever and transfer the yarn from a full package to an empty tube core rapidly without aspirating any yarn to waste. This invention relates to a no waste transfer system in which a suction gun is not used to capture and transfer the yarn, but rather the yarn is snagged on an empty tube core and instantaneously severed from the full core without wasting any yarn in the process. With some yarns, the tension build-up during snagging is sufficient to break the yarn and accomplish the severing. However for aramid fibers of moderate denier, the yarn is exceptionally strong and does not break except at high force levels. Therefore, an automatic cutting device which is actuated by the tension build-up in the yarn is needed. The cutting device must be very reliable, since if a cut is not completed, the force necessary to break the yarn of higher denier is high enough to damage the winder. An automatic cutting device must also be extremely fast acting so that yarn is cut quickly at the instant of snagging, since aramid yarn has very little elongation under load and the forces build up rapidly. In addition, an automatic cutting device should handle yarns with a wide variety of deniers, since it is most economical to use one cutter for a wide variety of products.

SUMMARY OF THE INVENTION

The present invention involves a yarn cutting apparatus with a cutting mechanism having a cutter body, actuator means, cutting means and valve means.

The cutter body has a bore with a slot extending transversely from the side of the body through the bore to a slot bottom wherein the slot is adapted to receive a yarn which can be cut.

The actuator means is pivotably affixed to the cutter body and adjacent to the bottom of the slot. The actuator means includes a yarn contact surface on an actuator arm which is located at one end of the cutter body and a valve shifting means at the other end of the cutter body. The actuator means pivots upon force exerted on its surface by contact with the yarn.

The cutting means which cuts the yarn received in the slot as the actuator means pivots, includes a stationary cutting element affixed to the cutter body adjacent one side of the bore at the side of the slot opposite a first end of the bore and forming at least one edge of the slot, a piston slideably fitted into the bore and adapted to move from the first end of the bore toward the slot as a result of a valve means directing the pressurized fluid to the first end of the bore, a moveable cutting element affixed to the piston and adapted to pass by the stationary cutting element as the piston moves toward the slot, a biasing means to urge the moveable and stationary cutting elements, one against the other, thereby cutting the yarn received in the slot as the moveable cutting element passes by the stationary cutting element, and a spring biasing means to urge the piston against the first end of the bore.

The valve means is attached to the cutter body adjacent a first end of the bore and adapted to be controlled by a valve shifting means. The valve means directs the cutting means toward the yarn to be cut and includes the valve shifting means, a shiftable element, a valve body, and ports for selectively directing pressurized fluid from a source to the first end of the bore and from the bore to the atmosphere allowing the piston to slide toward the stationary cutting element against the urging of the spring biasing means.

In an alternative way to view the cutter of this invention, the cutter body can be considered to include the cutter body, itself, and the cutting means.

In operation, the tensioned yarn passes over the yarn contact surface on the actuator arm and through the cutting slot in the cutter body. At a predetermined tension, the yarn causes the actuator means to pivot and raises the valve shifting means allowing the valve means to direct pressurized air to force the piston which has an attached moveable cutting element to slide across the stationary cutting element which is affixed to the cutter body. The moveable cutting element and the stationary cutting element are urged, one against the other, by a biasing means; preferably by an appropriately positioned pair of elastomeric O rings. As the cutting edge of the moveable cutting element slides across, and makes line to surface contact with, the cutting edge of the stationary cutting element, the tensioned yarn is cut. The piston with the attached moveable cutting element may be prevented from rotating in a cylinder bore by an anti-rotational pin. The actuator arm may have a sharp angled edge on the yarn contact surface which can serve as a secondary cutter.

DETAILED DESCRIPTION OF THE INVENTION

Figure 1A:
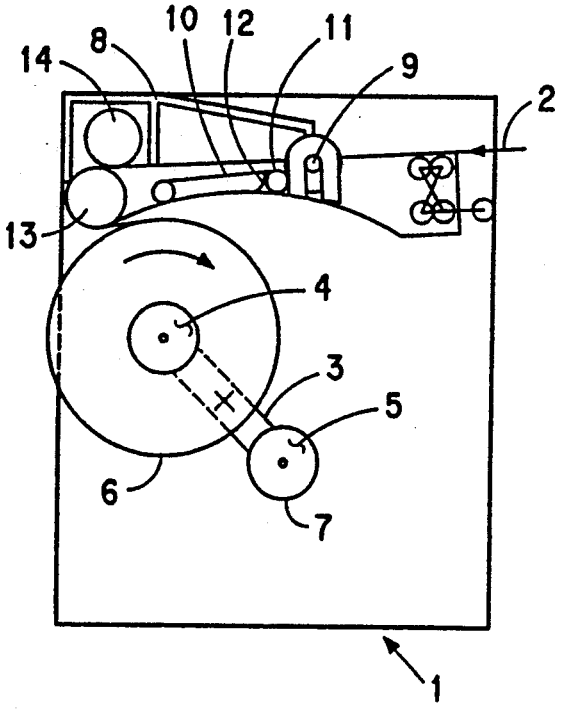
FIGS. 1A-1H are side elevational views of a winder for yarn shown at different positions in a cycle for accomplishing no waste auto cutting and transferring of the yarn.

FIGS. 1A-1H show a diagram of a winder 1 for yarn, with the winder shown at different positions in a cycle for accomplishing no waste auto transfer of the yarn 2. It features a turret 3 on which are mounted two powered chucks 4 and 5, each chuck holding two packages of yarn such as full packages 6 or empty tube cores 7, one next to another. Mounted on a moveable frame member 8, pivotable about support 9, are two pivot arms 10, on the ends 11 of which are located cutters 12 of this invention. During winding pivot arms 10 are out of the way of the yarn packages as shown and full packages 6 are adjacent to but spaced from, bale roll 13 which is adjacent to and spaced from a traverse means 14 shown in FIG. 1A. Traverse means 14 reciprocates the winding yarn along the longitudinal axis of the packages to ensure even distribution of the yarn on the package. Referring to FIG. 1J, although there are shown two yarns 2*a* and 2*b*, two packages 6*a* and 6*b*, and two cutters 12*a* and 12*b*, for simplicity of explanation, only one winder system will be referred to in the following discussion of FIG. 1.

Figure 1B:
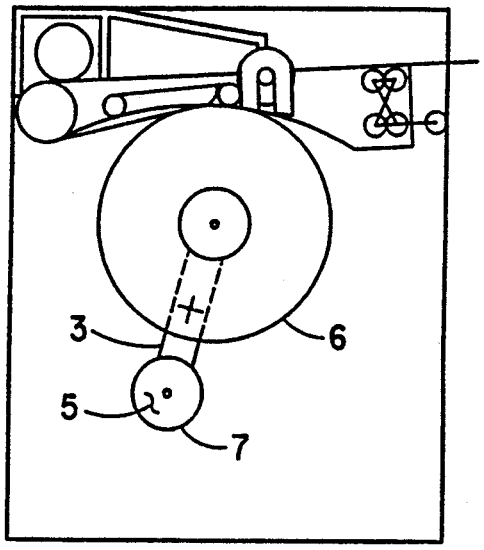
Figure 1C:
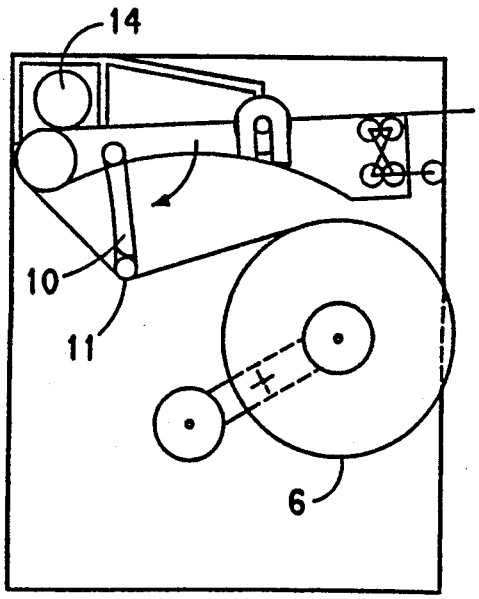
Figure 1D:
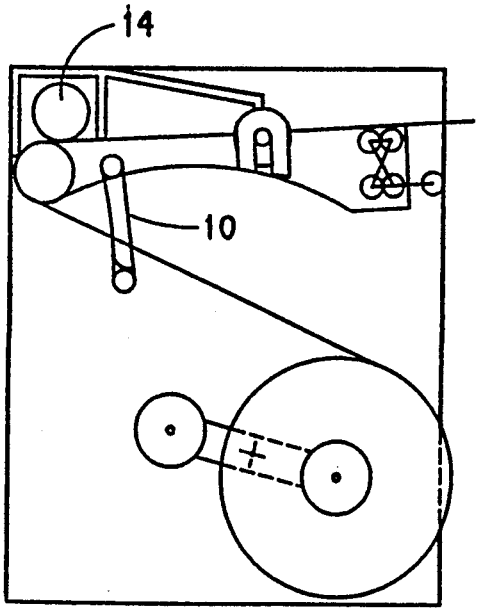
Figure 1E:
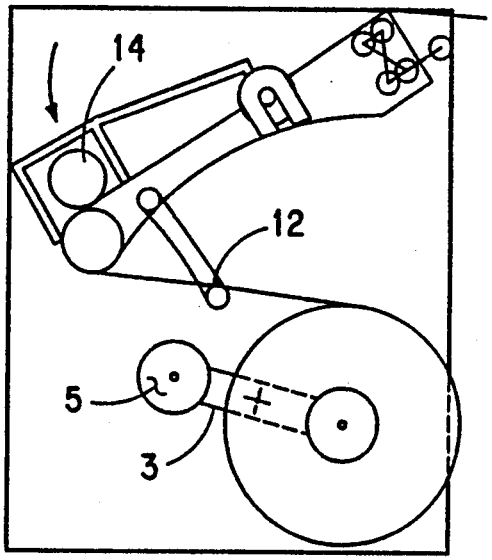
Figure 1F:
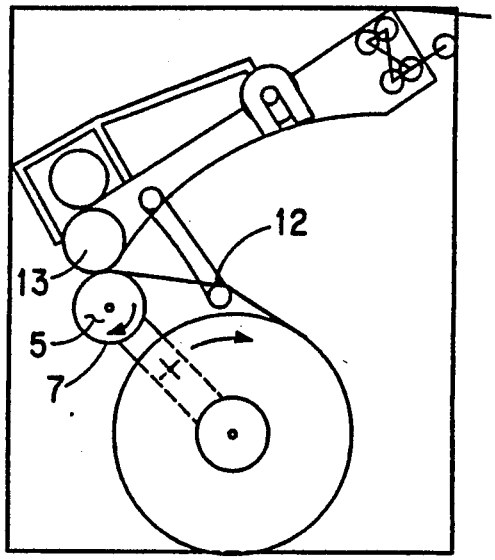
Figure 1G:
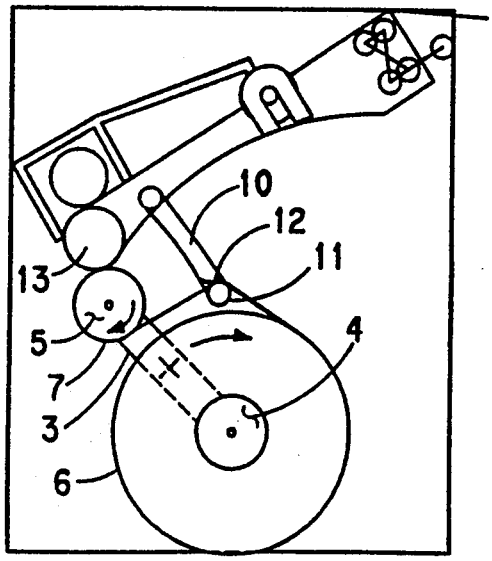
Figure 1H:
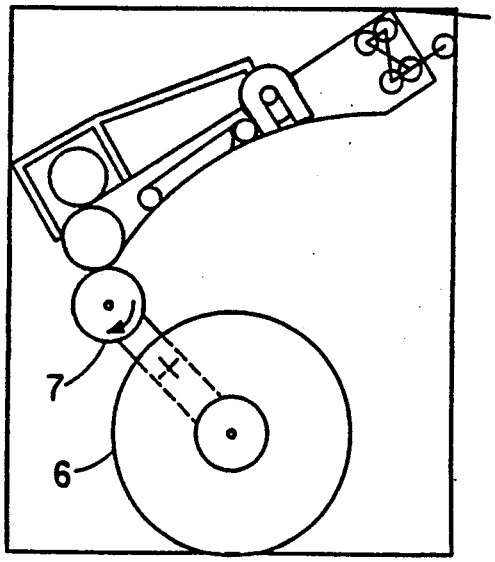
Figure 1J:
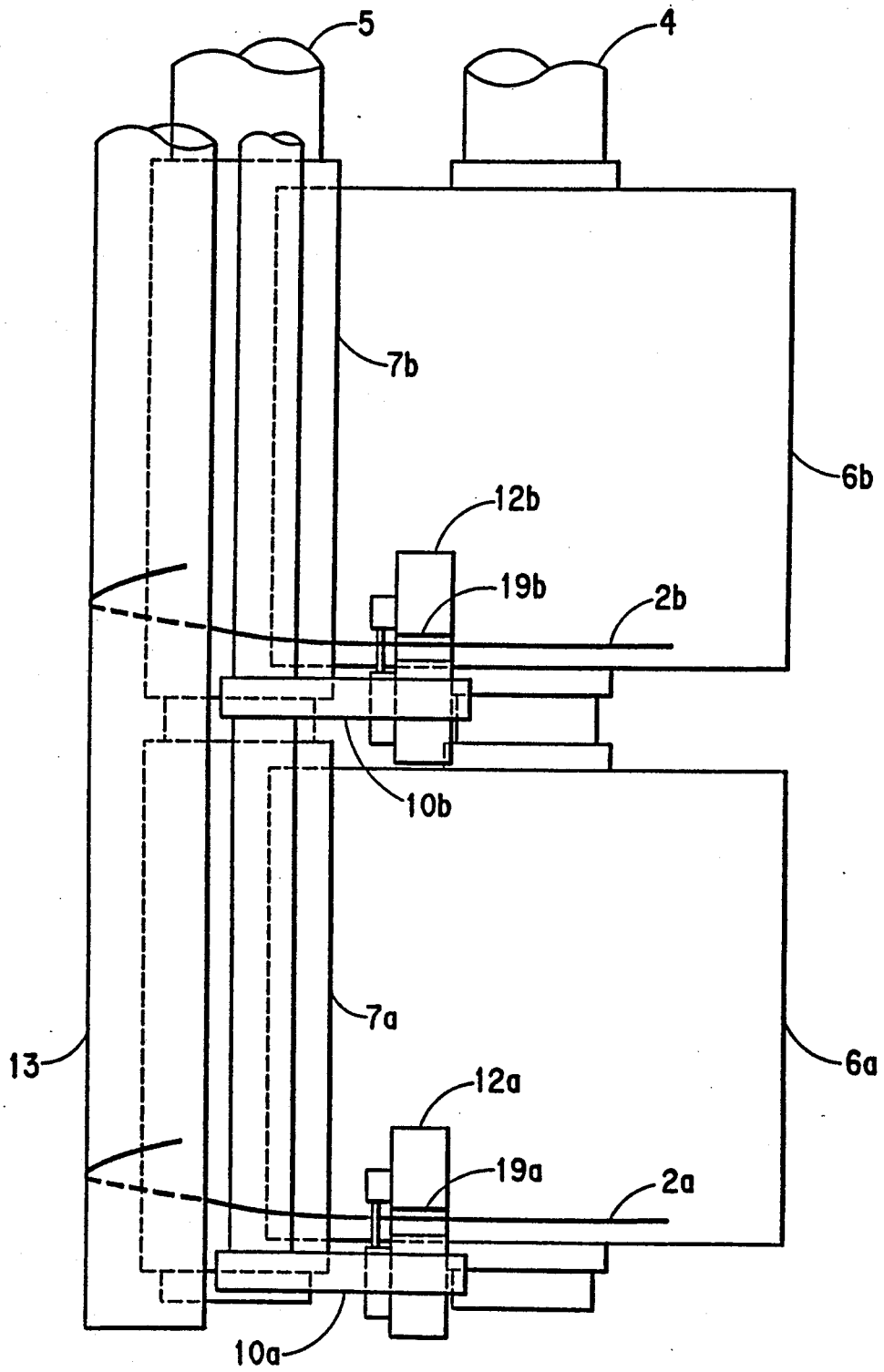
FIG. 1J is a top view of the winder shown in FIGS. 1F.

When the yarn package is at the desired diameter, the turret 3 moves full package 6 away and chuck 5 with empty tube core 7 is brought up to speed, as shown in FIG. 1B. At this point, the yarn is still being wound on full package 6. When the full package is clear as in FIG. 1C, pivot arm 10 is dropped down and the bottom surface at end 11 may contact and deflect the traversing yarn line as shown. As traverse means 14 moves the yarn to the inboard side of the full package, the yarn goes past the end of the arms 10 and springs back to its normal path which is now above the end 11 and cutter 12, as shown in FIG. 1D. As turret 3 continues rotating the full package, the yarn approaches the cutter body. At this point, as shown in FIG. 1E, the yarn is disengaged from the traverse and engaged by a holding guide (not shown) to hold the yarn at the end of the core in line with a snagging device on chuck 5. As the yarn moves toward the cutter 12 due to turret rotation, it enters a slot in the body of each cutter 12 mounted on the arm. FIG. 1J shows yarns 2*a* and 2*b* in slots 19*a* and 19*b* just before snagging and the commencement of winding on cores 7*a* and 7*b*. In FIG. 1F, the empty tube core 7 is shown to be approaching bale roll 13 ready to begin winding yarn which is still being wound on full package 6. As chuck 5 reaches bale roll 13, snagging devices on chuck 5 (not shown) grab the yarn and start wrapping it on rotating empty tube core 7, as shown in FIG. 1G. This causes a yarn segment to wrap sharply over cutter 12 and build up yarn tension rapidly as the yarn is pulled in one direction by rotating chuck 5 and in an opposite direction by rotating chuck 4. At this point, the tensioned yarn actuates an air driven primary cutting mechanism in the cutter of this invention, to cut the yarn.

After cutting, one end of the yarn is wound on the full package while the other end of the yarn is wound on the empty tube core, thus completing the automatic transfer from full package 6 to tube core 7. Package 6 is now removed from chuck 4 and replaced with an empty tube core ready for the next transfer while yarn is being wound on tube core 7, as shown in FIG. 1H.

Figure 2A:
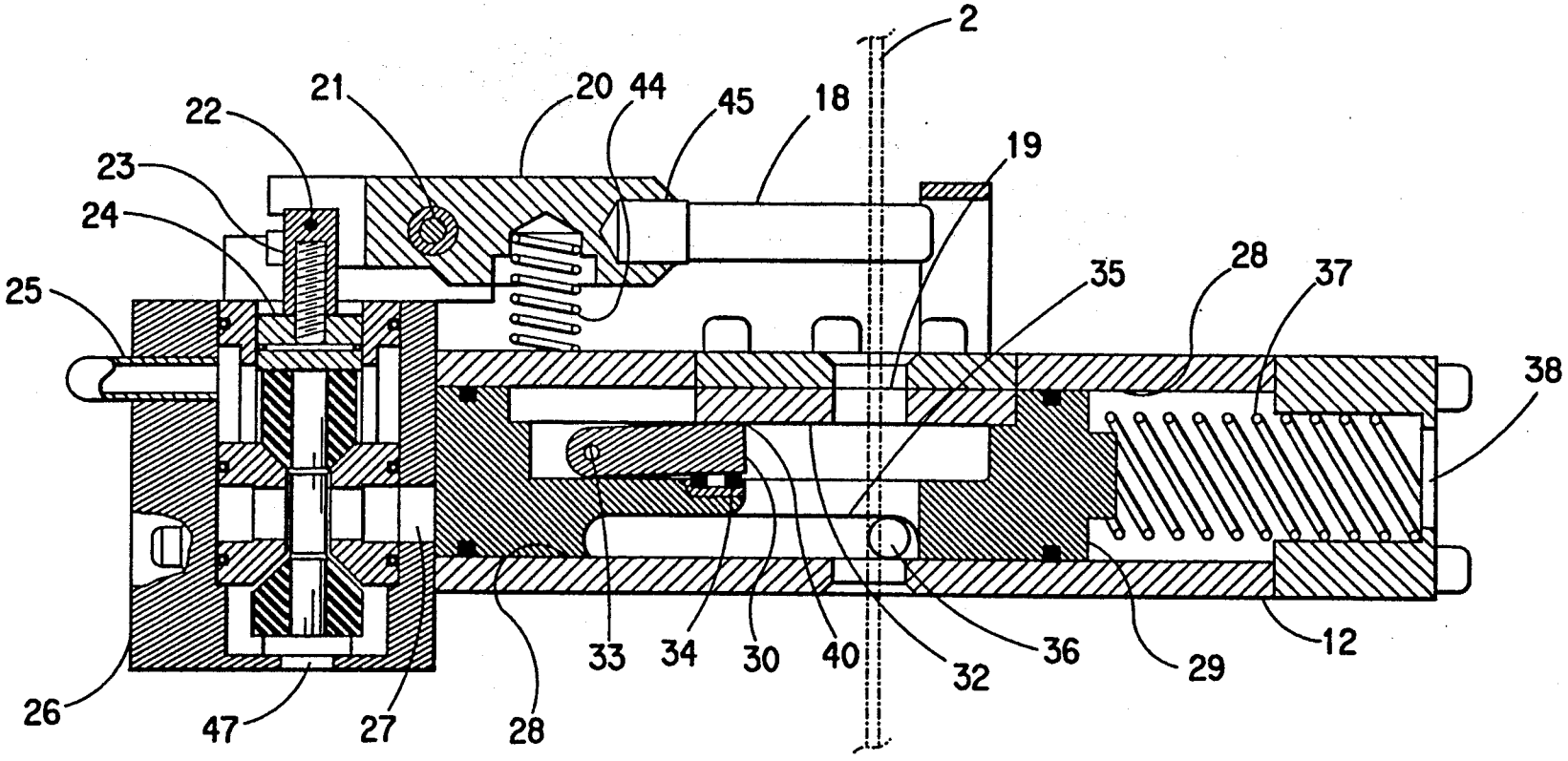
FIG. 2A is a sectional side view of the cutter of this invention with an actuating means, valve means, cylinder driving means and cutting means whereby the moveable cutting element is pivotable.
Figure 3:
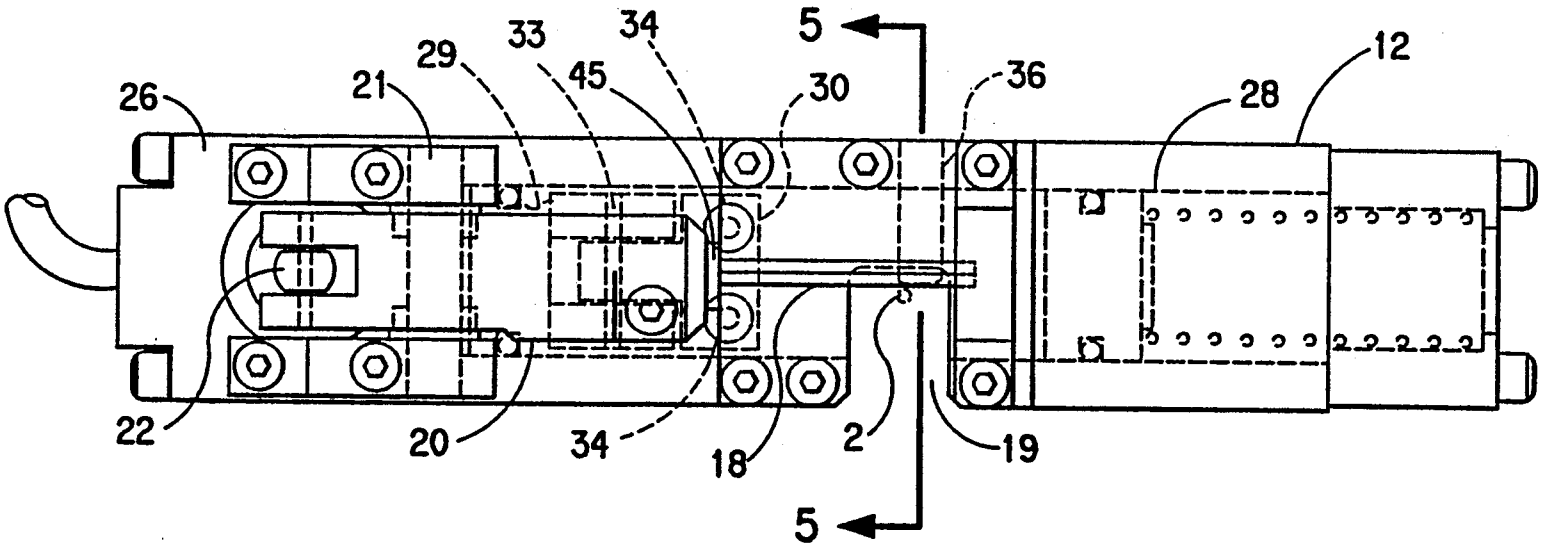
FIG. 3 is an overhead view of FIG. 2A.

FIGS. 2A and 3 show one embodiment of the cutter featuring a cutter body 12 having a slot 19 extending transversely through a bore 28 in the body wherein a yarn strand 2 may be accepted; an actuator means pivotably affixed to the cutter body 12, the actuator means including a yarn contact surface 18 and a valve shifting means 22; a valve means attached to, or part of, body 12 and including a shiftable element 24 connected to the actuator means, the element acting to alternatively direct a pressurized fluid from a source entering at port 25 to a first end of bore 28 through port 27 or from bore 28 to the atmosphere through port 47; a cutting means including a slotted piston 29 moveable by the fluid pressure directed into bore 28, the piston having a moveable cutting element 30 attached, which when moved by the piston is positioned to traverse slot 19 and pass by a stationary cutting edge on cutting element 32 fixed to body 12 at the side of the slot furthest from the first end of the bore, the cutting elements urged one against the other thereby cutting any yarn received in the slot. By close coupling the actuator arm 45 and valve body 26 to the cutter body 12, the cutting means is very fast acting, reliable and simple in construction.

Figure 5:
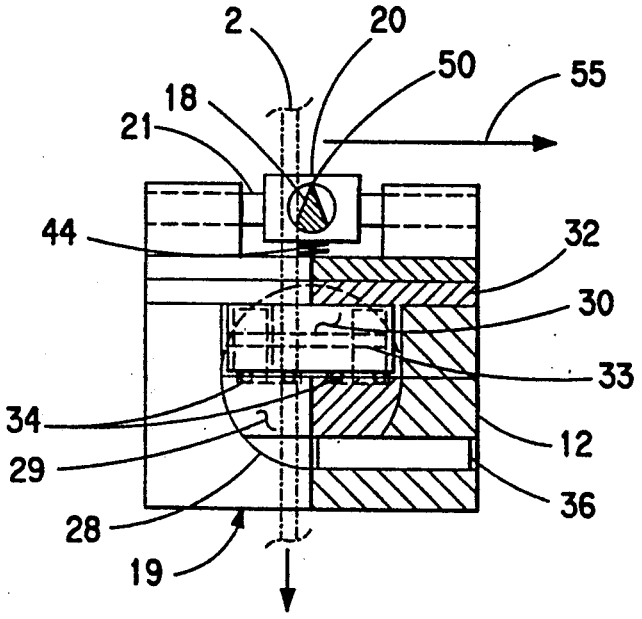
FIG. 5 is a sectional end view of the cutter of FIG. 3, shown by arrows 5—5.

The actuator means is attached to the body 12 by pivot pin 21 passing through clamp 20. The actuator includes an arm 45 having a yarn contact surface 18 which is shown in FIG. 5 with a sharp angled edge 50, with the arm held in clamp 20 pivotable about pivot 21, as shown in FIG. 2A. At the other end of the clamp from the arm, a valve pin 22 engages the end 23 of a shiftable element 24 which resembles a piston. Spring 44 pivotally urges clamp 20 and attached yarn contact surface 18 away from body 12 and urges shifting means 22 toward body 12 thereby forcing shiftable element 24 downward until it seals off the pressurized fluid from port 25. Referring to FIG. 5, when yarn 2 is pulled in the direction of arrow 55, there is a net force acting on surface 18 of arm 45 which compresses spring 44 and pivots clamp 20 and thereby raises shiftable element 24 (See, also, FIG. 2A).

The valve means has valve body 26 supplied with pressurized air through port 25. Port 27 provides fluid communication between valve body 26 and cylinder bore 28 where the pressurized air acts on one end of slotted piston 29. Port 47 is an exhaust port from valve body 26 to direct pressurized air from bore 28 through port 27 to the atmosphere. As, also, shown in FIG. 2A, when there is no yarn 2 under tension acting against surface 18, actuator arm 45 is not depressed and shiftable element 24 is in the closed position. As a result, pressurized air from port 25 is blocked from bore 28, exhaust port 47 is open, and no pressure acts on piston 29.

When yarn 2 is placed under tension acting against surface 18, actuator arm 45 is depressed, clamp 20 pivots to permit shiftable element 24 to open. When the shiftable element is open, fluid communication with port 47 is blocked and communication with port 25 is open allowing pressurized air to communicate through port 27 to bore 28. The pressurized air acts on piston 29 and attached cutting element 30 causing it to move rapidly and forcefully across cutting slot 19 where yarn 2 is passing under tension on the way to the winding package, thereby shearing the yarn against the cutting edge of stationary cutting element 32.

If the air driven primary cutting means fails, the sharp angled edge 50 on the actuator arm 45 may provide a back-up or secondary cutting capability so that cutting of light denier yarns is assured, but at a high tension.

The cutting means of FIGS. 2A, 3 and 5 comprise a piston 29 slidably fitted into the bore 28, a pivotable cutting element 30 mounted on the piston 29, and a fixed cutting element 32 mounted at the side of bore 28 with the cutting edge 42 (FIG. 2B) located at the side of the slot furthest from a first end of the bore where the pressurized fluid is admitted at port 27. A spring 37 between body 12 and piston 29, urges piston 29 against the first end of the bore. Moveable cutting element 30 is pivotably mounted to piston 29 at pivot point 33. Resiliant biasing means 34 placed between the piston and moveable cutting element can consist of elastomeric "O rings" that uniformly direct moveable cutting element 30 away from piston 29 and holds it against the flat surface of stationary cutting element 32 which is rigidly attached to the housing of the cutting body. It has been determined that elastomeric O rings having a durometer of 85 are, generally, eligible for use in this invention. Larger denier yarns can use O rings of greater hardness and smaller denier may be able to use O rings of lower hardness. Piston 29 is closely guided in cylinder bore 28 and is prevented from rotating by the sliding contact of cutout 35 in the piston with an anti-rotational pin 36 in the cylinder bore 28. During the cutting stroke of the piston, spring 37 is compressed and air to the right of the piston is forced out of the cylinder bore 28 through opening 38.

For reliable cutting, it is desirable to achieve a line to surface contact between the edge of moveable cutting element 30 and the surface of stationary cutting element 32. This line to surface contact can occur by urging one cutting element against the other cutting element in a pivoting motion. The pivoting motion can be accomplished on either the stationary or the moveable cutting element. FIG. 2A shows an embodiment wherein the moveable cutting element is pivotable.

It is important that the cutting elements are closely guided so that a line to surface contact occurs continuously between the two cutting edges as they pass by each other to cut the yarn. It is also important that the cutting edges are urged together with uniform loading. The elastomeric O rings are preferred for such urging.

Figure 2B:
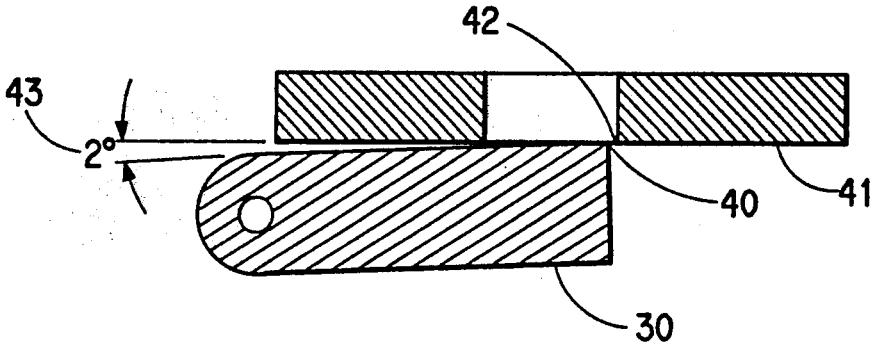
FIG. 2B is a sectional side view of the moveable cutting element in line to surface contact with the stationary cutting element.

FIG. 2B further shows this line to surface contact. In FIG. 2B, the contact between cutting edge 40 of moveable cutting element 30 and the surface 41 of stationary cutting element 32 is a line to surface contact. A line to surface contact is important in order that, as cutting edge 40 slides across cutting edge 42 of stationary cutting element 32, the yarn is cleanly cut. Any gaps or separation between the cutting edges would result in an incomplete and ragged cut. The line to surface contact is achieved by providing an angle of about two degrees at 43 between moveable cutting element 30 and stationary cutting element 32.

FIGS. 3 and 5 show an overhead view and section view, respectively, of FIG. 2A in which the resiliant biasing means, consisting of two elastomeric O Rings 34, located between piston 29 and moveable cutting element 30, urges the moveable cutting element 30 away from piston 29 and towards stationary cutting element 32, thus insuring that the cutting edges are urged together with uniform loading. Close tolerancing of the cutting means parts and careful assembly, which may include shim spacing under the O rings to get the desired O ring compression, may be required to assure a significant load between the cutting elements.

It is important that the cutting elements are constructed of materials that will slide readily against one another and will withstand many cycles of reliable cutting. One material which is known to work well is C-2 grade tungsten carbide having a finish at the cutting edge that is finer than 20 microinches and is coated with chemical vapor deposition coatings of 2 microns of titanium carbide and further coated with 2 microns of titanium nitride. Another material which is known to work well is alumina ceramic, one version of which is called Aremcolox, grade 502-1400, furnished by Aremco Products, Inc. in Ossining, N.Y., U.S.A. The alumina ceramic should also have a finish finer than 20 microinches. The same materials can be used for both cutting edges or different materials can be used for each edge. The combination of these materials with the line contact of the cutting elements and the resilient loading of the elements against one another produces surprisingly reliable, long life cutting.

Referring again to FIG. 2A, after the yarn is cut, spring 44 moves clamp 20 up and shiftable element 24 is moved down. Moving the shiftable element down, opens vent port 47 and blocks supply port 25. Spring biasing means 37 acting on piston 29 returns the piston and moveable cutting element 30 to its original position, thereby clearing slot 19 for introduction of the next yarn to be cut.

Figure 4:
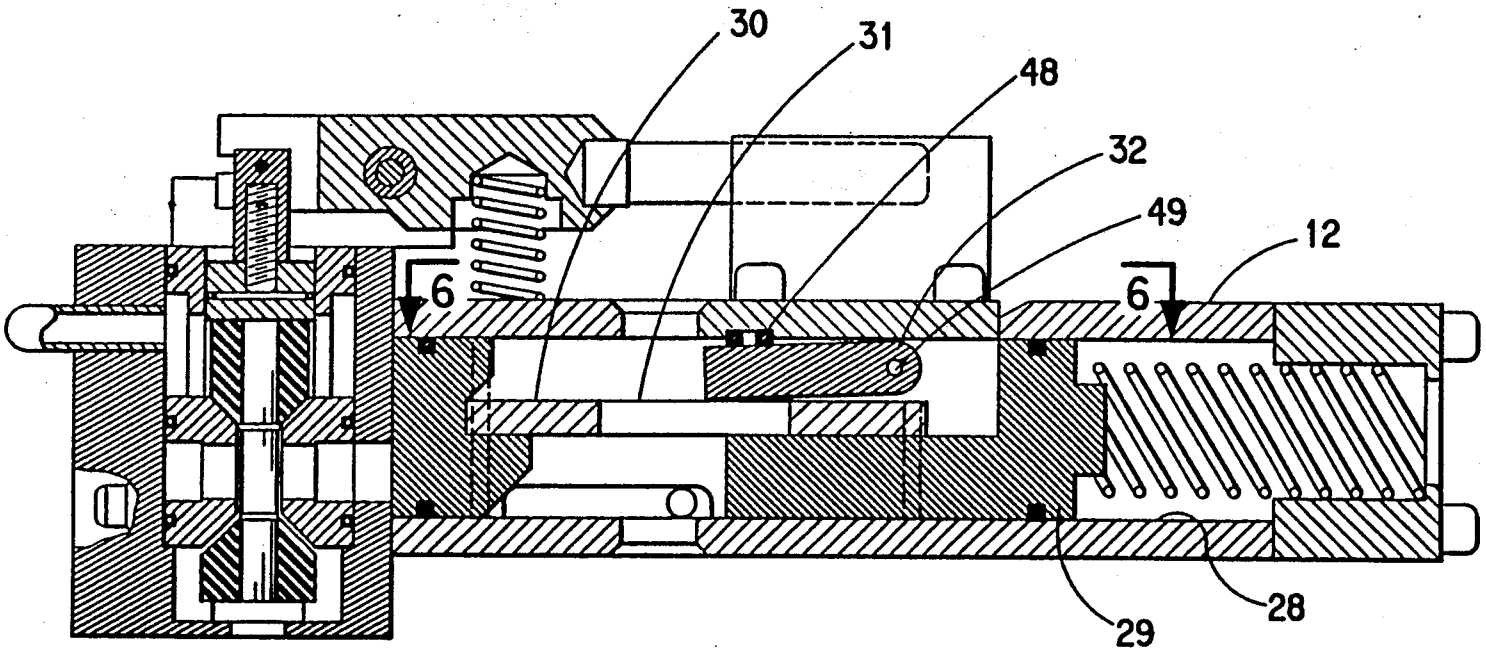
FIG. 4 is a sectional side view of the cutter of this invention with an actuating means, valve means, cylinder driving means and cutting means whereby the stationary cutting element is pivotable.
Figure 6:
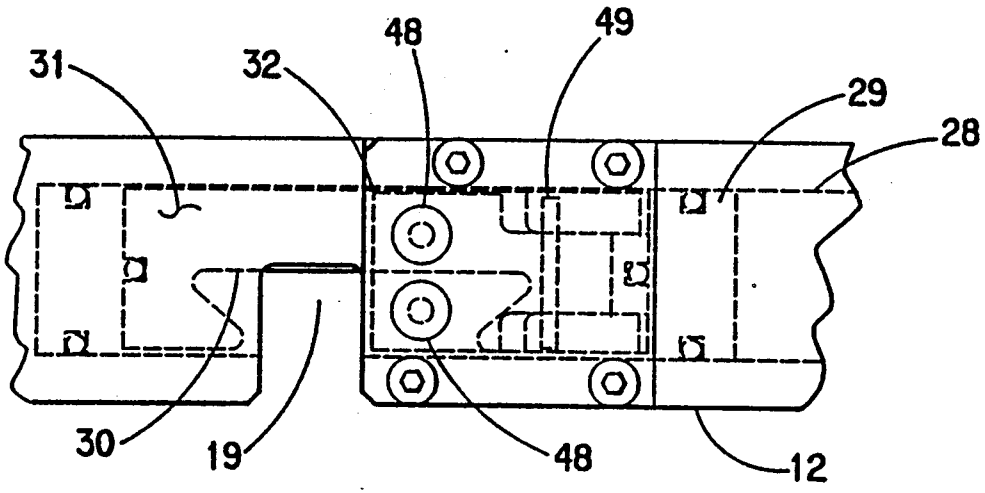
FIG. 6 is a partial overhead view of one embodiment of the cutter of this invention identified as view 6—6 in FIG. 4.

FIGS. 4 and 6 show an embodiment of the cutter of this invention in which stationary cutting element 32 is pivotable; and moveable cutting element 30 is part of a slotted bar 31 which is attached to piston 29. Stationary cutting element 32 is pivotably mounted to cutter body 12 at pivot 49. A resilient biasing means consisting of elastomeric O rings 48 urges stationary cutting element 32 away from cutter body 12 and holds it against moveable cutting element 30. The cutting element 30, of slotted bar 31 may be shaped in a way that guides the yarn into the cutting zone at the moment of cutting. This shaped cutting edge is an advantage if there is low tension on the yarn. The shape also provides a balanced contact of the elements on both sides of the yarn at the moment of cutting. Repetition of the shape at the opposite end of moveable cutting element 30 permits flipping the element to provide a fresh cutting edge.

In each embodiment of the cutter, the cutting of the yarn occurs very rapidly before any damaging tension is created. The high speed of the cut is a result of the direct connection between the actuator arm and the valve, the short distance the air must travel to the piston, and the relatively short distance the piston (with the attached moveable cutting element) must travel to cut the yarn. However, the piston moves a sufficient distance to allow the moveable cutting element to develop a high speed in order that it can rapidly cut the yarn against the stationary cutting element.

The cutter of the invention has been surprisingly effective in cutting aramid yarns with a wide range of deniers. For instance, for aramid yarns with deniers from about 200 to about 800, the tensioned yarn can be cut by the secondary cutter, that is, the sharp edge 18 of the actuator arm; for deniers of from about 800 to 7500, the tensioned yarn deflects the actuator arm and the primary cutter elements 30 and 32 cut the yarn. In one test with 3000 denier poly(p-phenylene terephthalamide) yarn winding at about 1000 yds/min, over 2000 cuts were made without failure. Such reliable long lasting cutting operation has not been obtained with other known shear cutters or with impact or grinding type cutters.

I claim:

1. A yarn cutter, comprising (a) a cutter body containing a bore therethrough with a slot extending transversely from a side of the cutter body through the bore to a slot bottom, the slot adapted to receive a yarn;

(b) an actuator means pivotably attached to the cutter body and comprising;

(i) a yarn contact surface on the actuator means adjacent the bottom of the slot, wherein a force exerted on the yarn contact surface by contacting yarn received in the slot causes the actuator means to pivot, and (ii) a valve shifting means attached to the actuator;

(c) a valve means attached to the cutter body adjacent a first end of the bore and adapted to be controlled by the valve shifting means, the valve means having a shiftable element adapted to alternately direct a pressurized fluid from a source to the first end of the bore and from the bore to the atmosphere; and (d) a cutting means adapted to cut the yarn received in the slot, comprising;

(i) a piston slideably fitted into the bore and adapted to move from a first end of the bore which is in communication with a source of pressurized fluid toward the slot as a result of the valve means directing the pressurized fluid to the first end of the bore;

(ii) a stationary cutting element affixed to the cutter body adjacent one side of the bore at a side of the slot opposite the first end of the bore;

(iii) a moveable cutting element affixed to the piston and adapted to pass by the stationary cutting element as the piston moves toward the slot, and (iv) a resilient biasing means to urge the stationary cutting element and moveable cutting element, one against the other, with a cutting edge of one cutting element continuously urged against a surface of the other cutting element, in a line to surface contact, thereby cutting the yarn received in the slot as the moveable cutting element passes by the stationary cutting element.

2. The yarn cutter of claim 1, wherein the stationary cutting element is pivotably affixed to the cutter body and the resilient biasing means is mounted between the stationary cutting element and the cutter body.

3. The yarn cutter of claim 2 wherein the resilient biasing means comprises a pair of elastomeric O rings.

4. The yarn cutter of claim 1, wherein the moveable cutting element is pivotably affixed to the piston and the resilient biasing means is mounted between the moveable cutting element and the piston.

5. The yarn cutter of claim 4 wherein the resilient biasing means comprises a pair of elastomeric O rings.

6. The yarn cutter of claim 1, wherein the yarn contact surface has a sharp edge.

7. The yarn cutter of claim 1 wherein the bore and piston are cylinderical and further including means to prevent rotation of the piston in the bore.

8. The yarn cutter of claim 1 wherein the cutting elements are made from alumina ceramic.

9. The yarn cutter of claim 1 wherein the cutting elements are made from tungsten carbide coated first with titanium carbide and then with titanium nitride.

10. The yarn cutter of claim 1 wherein one of the cutting elements is made from tungsten carbide coated first with titanium carbide and then with titanium nitride, and the other element is made from alumina ceramic.

11. A yarn cutter comprising:

(a) a cutter body having a slot extending transversely through a bore in the body;

(i) a stationary cutting element affixed to the cutter body, forming at least one edge of the slot, and located at one surface of the bore;

(ii) a piston slideably fitted into the bore and adapted to move from a first end of the bore which is in communication with a source of pressurized fluid toward the slot;

(iii) a moveable cutting element affixed to the piston in contact with the stationary cutting element, (iv) a spring biasing means to urge the piston against one end of the bore; and (v) a resilient biasing means to urge the stationary cutting element and moveable cutting element, one against the other, with a cutting edge of one cutting element continuously urged against a surface of the other cutting element, in a line to surface contact;

(b) an actuator means pivotably affixed to the cutter body comprising;

(i) an actuator arm having a yarn contact surface at one end of the cutter body adjacent to the slot, and (ii) a valve shifting means at the other end; and (c) a valve body affixed to the cutter body;

(i) a valve shiftable element in the valve body located to be controlled by the valve shifting means, and (ii) ports in the valve body for selectively directing pressurized fluid from a source into the bore to move the piston against the urging of the spring biasing means.

12. The yarn cutter of claim 11 wherein the stationary cutting element is pivotably affixed to the cutter body and held against the moveable cutting element by a resilient biasing means located between the stationary cutting element and the cutter body.

13. The yarn cutter of claim 12 wherein the resilient biasing means comprises a pair of elastomeric O rings.

14. The yarn cutter of claim 11 wherein the moveable cutting element is pivotably affixed to the piston and is biased away from the piston and held against the stationary cutting element by a resilient biasing means located between the moveable cutting element and the piston.

15. The yarn cutter of claim 11 wherein the actuator arm has a sharp edge on the yarn contact surface.

* * * * *